US011167400B2

(12) United States Patent
Chan

(10) Patent No.: US 11,167,400 B2
(45) Date of Patent: Nov. 9, 2021

(54) RATCHET WRENCH HAVING MULTIPLE DRIVING MODES WITH TORQUE SENSING FUNCTION

(71) Applicant: Rong-Suei Chan, Taichung (TW)

(72) Inventor: Rong-Suei Chan, Taichung (TW)

( * ) Notice: Subject to any disclaimer, the term of this patent is extended or adjusted under 35 U.S.C. 154(b) by 369 days.

(21) Appl. No.: 16/224,822

(22) Filed: Dec. 19, 2018

(65) Prior Publication Data

US 2020/0198105 A1 Jun. 25, 2020

(30) Foreign Application Priority Data

Oct. 4, 2018 (TW) ..... 107135084

(51) Int. Cl.
*B25B 23/142* (2006.01)
*B25B 23/147* (2006.01)
*B25B 13/46* (2006.01)

(52) U.S. Cl.
CPC ..... *B25B 23/1425* (2013.01); *B25B 13/465* (2013.01); *B25B 23/147* (2013.01)

(58) Field of Classification Search
CPC ... B25B 23/1425; B25B 23/17; B25B 13/465; B25B 23/46
USPC ..... 81/479
See application file for complete search history.

(56) References Cited

U.S. PATENT DOCUMENTS 6,457,386 B1 10/2002 Chiang
9,038,505 B2 5/2015 He
2018/0071901 A1* 3/2018 Silha ..... B25B 21/004
2020/0171631 A1* 6/2020 Hu ..... B25B 13/461

* cited by examiner

*Primary Examiner* — David B. Thomas
*Assistant Examiner* — Thomas Raymond Rodgers
(74) *Attorney, Agent, or Firm* — WPAT, PC

(57) ABSTRACT

A ratchet wrench having multiple driving modes with torque sensing function includes an annular head, a driving unit, a control unit, a rotary member, a forcing unit and at least one torque sensor. The annular head receives the driving unit therein and a shaft extends from the annular head. The driving unit has a first toothed ring engaged with a first pawl, and a second pawl engaged with inner teeth of the annular head. The rotary member is rotatably inserted in the shaft, and has two ends to the driving unit and the forcing unit respectively. The forcing unit includes a tubular handle and a display unit. The torque sensor is mounted on the shaft. The shaft inserts into an axial chamber of the handle. The torque sensor is positioned between the axial chamber and the shaft. When the shaft is bended by the handle to produce a deformation. The torque sensor senses the deformation of the shaft to generate a torque sensing signal, so that the display unit converts the torque sensing signal to a torque value and displays the torque value.

10 Claims, 11 Drawing Sheets

RATCHET WRENCH HAVING MULTIPLE DRIVING MODES WITH TORQUE SENSING FUNCTION

BACKGROUND OF THE INVENTION

1. Fields of the Invention

The present invention relates to a ratchet wrench, and more particularly, to a ratchet wrench having two kinds of driving modes with torque sensing function.

2. Descriptions of Related Art

The conventional ratchet wrench known to applicant is disclosed in U.S. Pat. No. 6,457,386 and comprises a main body, a drive shaft, a handle, a first annular gear, a second annular gear, a drive member, a pair of first pawls, a pair of second pawls, a rotating wheel, a control member, a plurality of balls, a plurality of compression springs, and a coiled spring. The main body has a through hole to receive the drive shaft, a pair of pivot holes, a groove to receive the drive member, and a plurality of inner teeth. The through hole communicates with the groove. The drive member has a through aperture and a chamber. The handle has a blind hole to receive the drive shaft. The first annular gear has a plurality of inner periphery serrations and a plurality of one-sided serrations. The second annular gear has a plurality of inner periphery teeth and a plurality of one-sided teeth. Each of the first pawls has a plurality of positioning recesses and a plurality of outer teeth. Each of the second pawls has a plurality of periphery serrations and a plurality of one-sided serrations. The rotating wheel has an oblong center hole. The control member has a pillar and a press disk disposed on the pillar. The pillar has a plurality of circular holes, and each of the circular holes of the pillar receives the corresponding compression spring and the corresponding ball. A pair of studs pass through the pivot holes of the main body and an annular recess of the drive shaft. The chamber of the drive member receives the first pawls and the second pawls. The first annular gear encloses one of the first pawls and one of the second pawls. The second annular gear encloses the other of the first pawls and the other of the second pawls. The pillar is inserted through the coiled spring, the oblong center hole of the rotating wheel, and the through aperture of the drive member. The coiled spring is disposed between the press disk and the rotating wheel, and each of the balls engages with one of the first pawls and the second pawls.

However, the two second annular gears are not adjustable relative to the driving member so that the engagement between the beveled teeth of the drive shaft and the two second annular gears may not be perfect as expected. Each of the driving member, the second annular gears and the drive shaft has its own tolerance, if the tolerance is too big, the engagement between the beveled teeth of the drive shaft and the two second annular gears is affected. The maximum diameter of the driving member has to be matched with the inner teeth of the inner teeth so that the driving member is supported by the inner teeth. The main body and the driving member are pivotably connected to the inner teeth, the pivotable connection between the main body and the driving member will be affected. The driving member is made as a one piece and this requires higher manufacturing cost.

Another ratchet wrench is disclosed in U.S. Pat. No. 9,038,505 has similar shortcomings as those in U.S. Pat. No. 6,457,386.

Another ratchet wrench is disclosed in U.S. Pat. No. 9,868,191 which is previous invention of the present inventor and has no torque sensing function.

The present invention intends to provide a ratchet wrench to eliminate the shortcomings mentioned above.

SUMMARY OF THE INVENTION

The present invention relates to a ratchet wrench and comprises an annular head, a driving unit, a control unit, a rotary member, a forcing unit and at least one torque sensor. The annular head receives the driving unit therein and a shaft extends from the annular head. The driving unit has a top part and a bottom part, a first toothed ring, a first pawl and at least one second pawl. The rotary member is rotatably inserted into an axial hole of the shaft and has one end mechanically engaged with the driving unit. The forcing unit includes a tubular handle and a display unit. The torque sensor is mounted on an outer periphery of the shaft. The shaft inserts into an axial chamber of the handle, so that the torque sensor is positioned between an inner wall of the axial chamber and the outer periphery of the shaft. When a user drives the handle to actuate the driving unit to drive a workpiece, the shaft is bended by the handle to produce a deformation. The torque sensor senses the deformation of the shaft to generate a torque sensing signal and transmits the torque sensing signal to the display unit, and the display unit converts the torque sensing signal to a torque value and displays the torque value.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
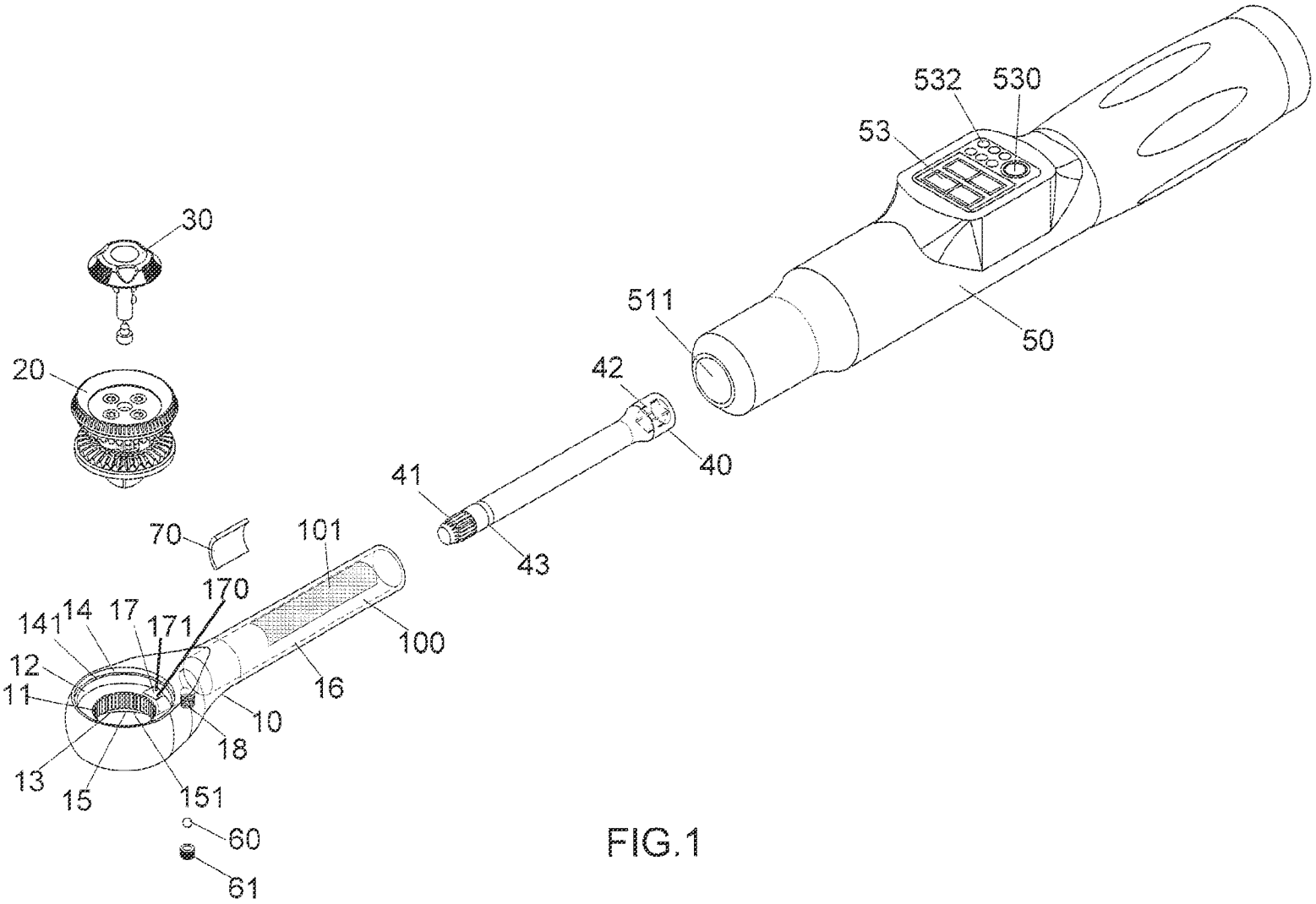
FIG. 1 is an exploded view of the ratchet wrench of the present invention.
Figure 2:
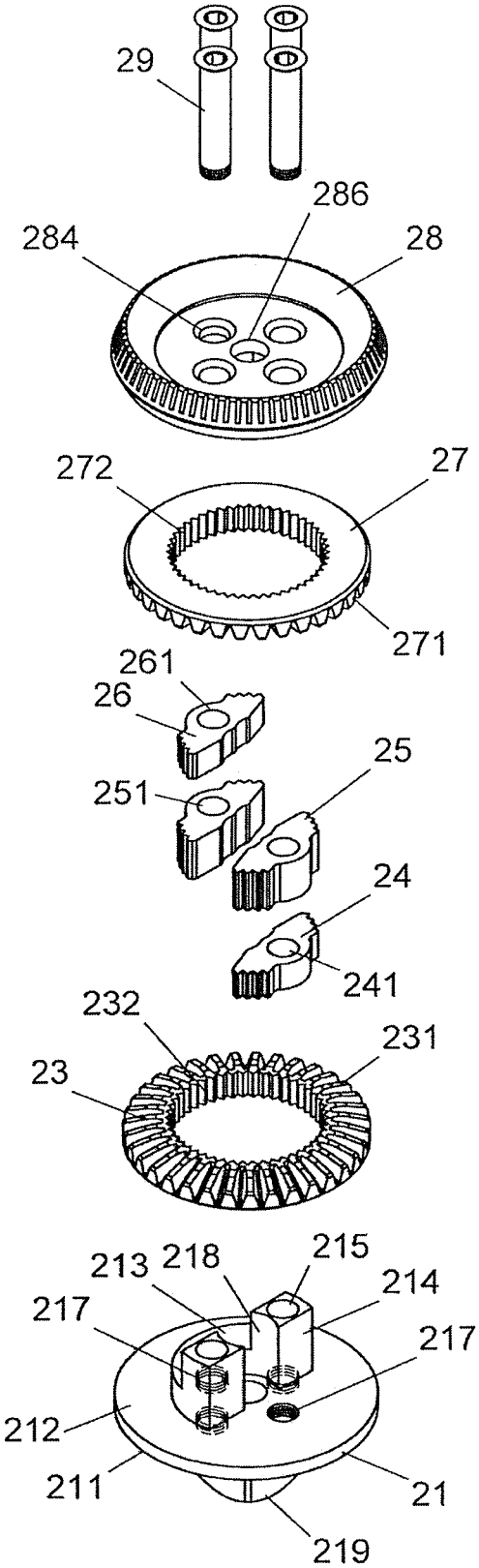
FIG. 2 is an exploded view of the driving unit of the ratchet wrench of the present invention.
Figure 4:
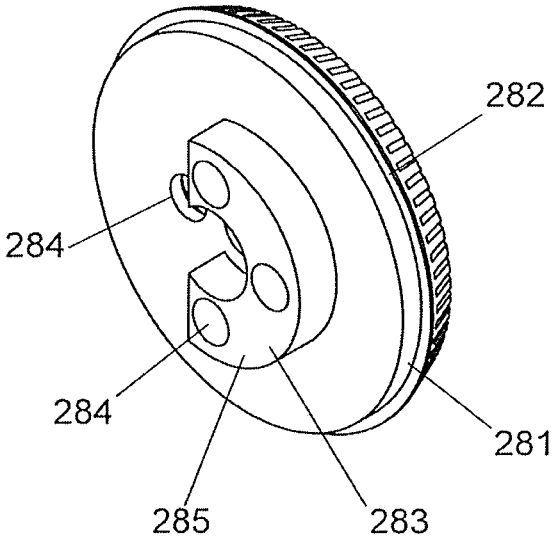
FIG. 4 is a perspective view to show the top part of the driving unit of the present invention.
Figure 3:
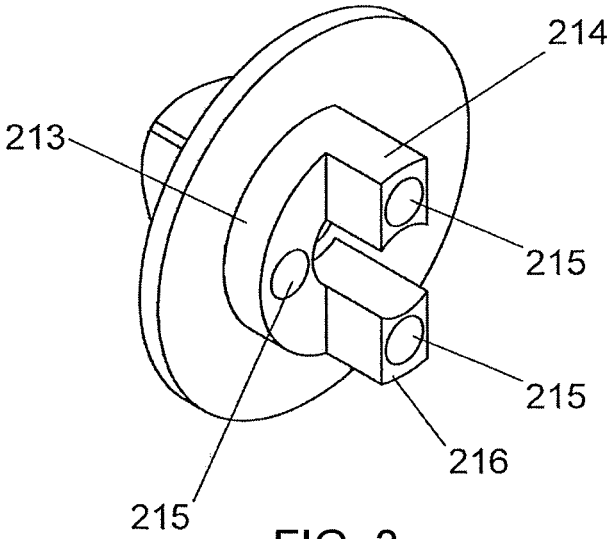
FIG. 3 is a perspective view to show the bottom part of the driving unit of the present invention.
Figure 5:
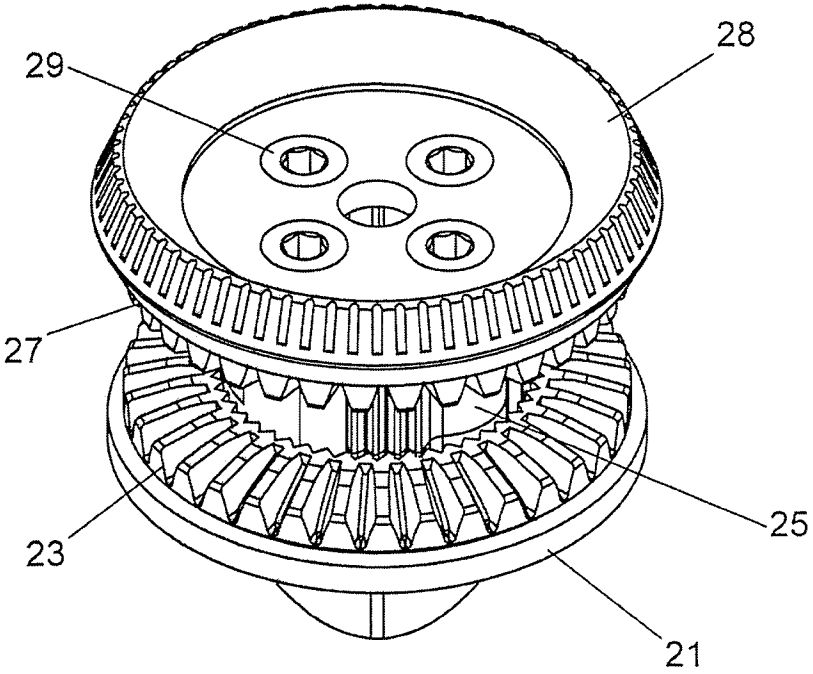
FIG. 5 is a perspective view to show the driving unit of the present invention.
Figure 6:
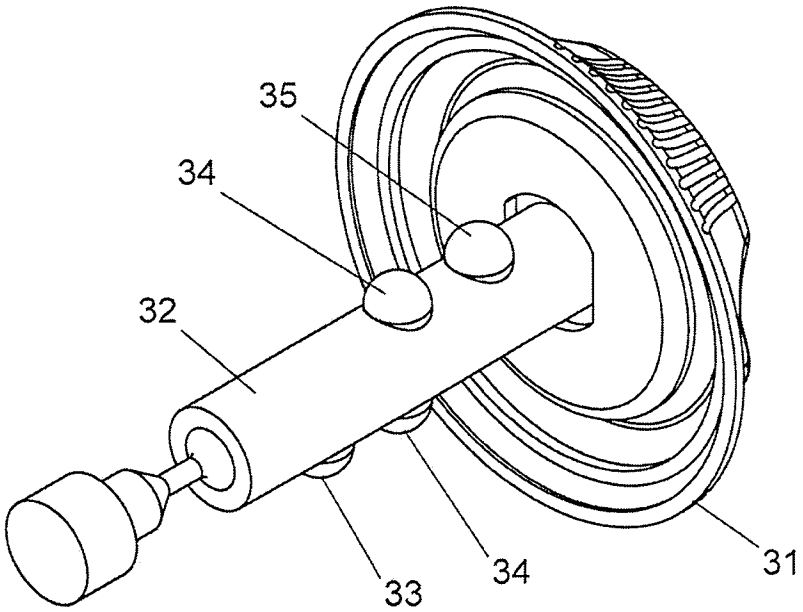
FIG. 6 is a perspective view to show the control unit of the present invention.
Figure 7:
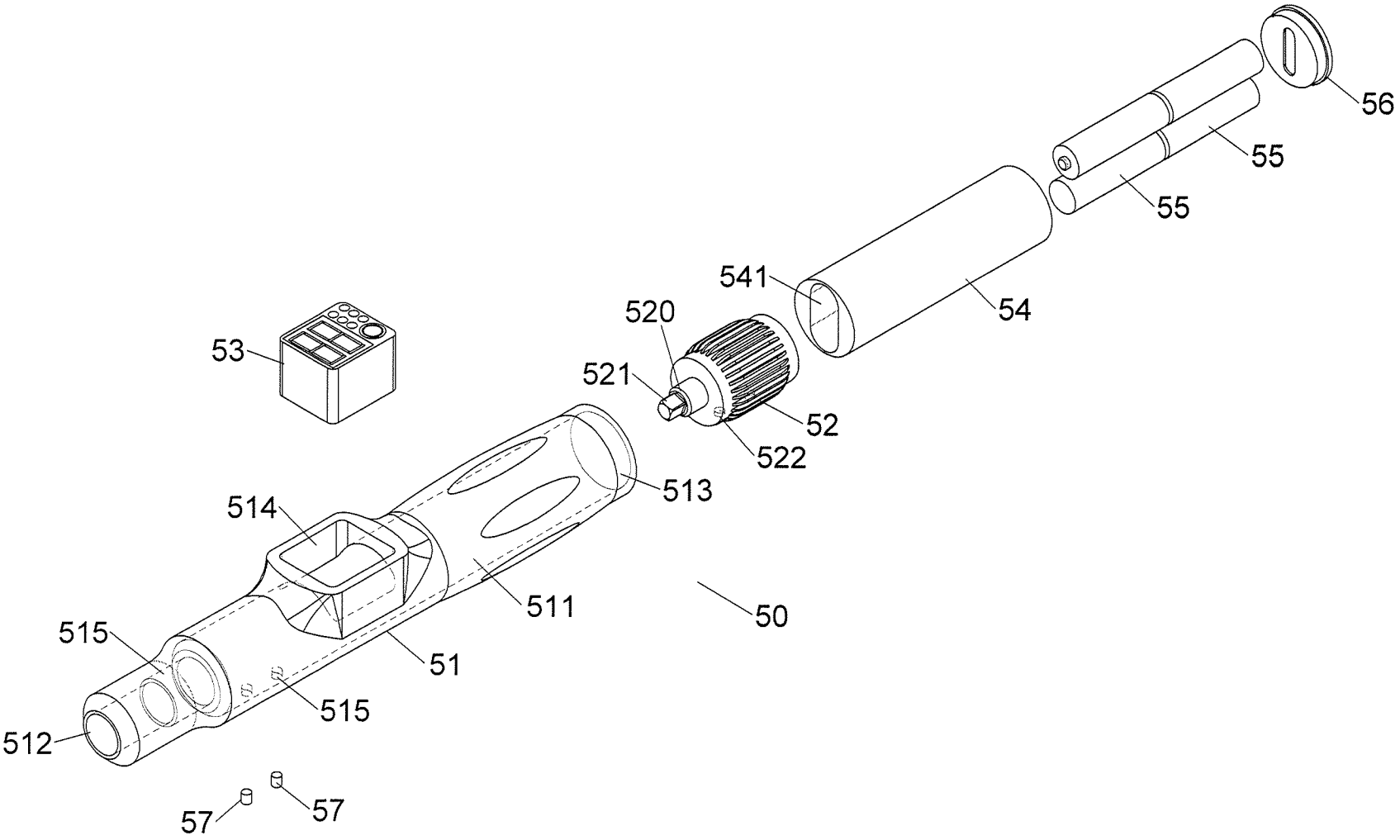
FIG. 7 is an exploded view of the forcing unit of the present invention.

Referring to FIGS. 1 to 12, the ratchet wrench of the present invention comprises an annular head 10, a driving unit 20, a control unit 30, a rotary member 40, a forcing unit 50, a bead 60, an end piece 61 and at least one torque sensor 70.

The annular head 10 has a shaft 100 extending therefrom. Multiple ratchet teeth 11 are defined in the middle portion of the inner periphery of the annular head 10. A first space 12 and a second space 13 are respectively defined in the top and the bottom of the inner periphery of the annular head 10, wherein the first and second spaces 12, 13 have the same diameter which is larger than the diameter enclosed by the ratchet teeth 11. A first groove 14 is defined in the inner periphery of the first space 12, and a second groove 15 is defined in the inner periphery of the second space 13. A first shoulder 141 is formed between the first groove 14 and the first space 12, and a second shoulder 151 is formed between the second groove 15 and the second space 13. An axial hole 16 is defined axially in the shaft 100. A communication hole 17 is defined in the inner end of the axial hole 16 and has a front end 170 communicates with the first and second spaces 12, 13 by lateral openings 171 of the front end 170. The communication hole 17 does not communicate the ratchet teeth 11. A receiving hole 18 is defined in one side of the shaft 100 and communicates with the axial hole 16.

The driving unit 20 is located in the annular head 10 and has a bottom part 21, a first toothed ring 23, a first pawl 24, two second pawls 25, a third pawl 26, a second toothed ring 27, a top part 28 and four locking members 29. The bottom part 21 is a round disk and its periphery is engaged with the second groove 15. The bottom part 21 has a first disk 212 which contacts the second shoulder 151. The first disk 212 has four locking holes 217, a base 213 and two columns 214. Each column 214 has a first end face 216. The height of the two columns 214 from the first disk 212 is higher than that of the base 213. The base 213 and the two columns 214 each have a circular hole 215 defined therethrough, and each circular hole 215 communicates with the locking hole 217 corresponding thereto. A receiving room 218 is formed between the base 213 and the columns 214, and each of the columns 214 is a rectangular column. Three of the locking holes 217 respectively extend through the base 213 and the first end faces 216 of the columns 214.

The bottom part 21 has a driving end 219 extending from the first disk 212. The driving end 219 is a rectangular end for being connected to a rectangular recess of a workpiece (such as a socket, a connection rod or an adapter). The first toothed ring 23 is located on the first disk 212 and mounted to the base 213 and rotatably received in the second space 13. The first toothed ring 23 having first teeth 231 and first inner teeth 232. The first inner teeth 232 have the same number teeth and inner diameter as the ratchet teeth 11. The first pawl 24 is pivotably connected to the first disk 212 and located on one side of the two columns 214 and located away from the base 213. A first toothed portion is formed on each of two ends of the first pawl 24 and engaged with the first inner teeth 232. The first pawl 24 has a first hole 241 which is located in alignment with one of the locking holes 217. One of the two second pawls 25 is mounted to the base 213, and the other second pawl 25 is located above the first pawl 24. The two second pawls 25 are located symmetrically to each other relative to the columns 214. A second toothed portion is formed on each of two ends of each of the second pawls 25 so as to be engaged with the ratchet teeth 11. Each of the two second pawls 25 has a second hole 251. The second hole 251 of one of the second pawls 25 that is located above the base 213 is located in alignment with the circular hole 215 and the locking hole 217 corresponding thereto. The second hole 251 of the other one of the second pawls 25 that is located above the first pawl 24 is located in alignment with the first hole 241 and the locking hole 217 corresponding thereto. The third pawl 26 is pivotably connected to the top of the second pawl 25 on the base 213. A third toothed portion is formed on each of two ends of the third pawl 26. A third hole 261 is defined through the third pawl 26 and which is located in alignment with the second hole 251, the circular hole 215 and one of the locking holes 217 corresponding thereto. The second toothed ring 27 is rotatably received in the first space 12 and has second teeth 271 which face the first teeth 231 at a distance. The second toothed ring 27 has second inner teeth 272 which are engaged with the third toothed portions of the third pawl 26. The second toothed ring 27 is identical to the first toothed ring 23.

The top part 28 is a round disk and faces the bottom part 21 at a distance. The periphery 281 of the top part 28 is rotatably received in the first groove 14. The top part 28 has a second disk 282 which contacts the first shoulder 141. A block 283 extends from the second disk 282. The second toothed ring 27 is mounted to the block 283. The top part 28 has four connection holes 284 which are located in alignment with the circular holes 215 and the locking holes 217. The block 283 has a second end face 285 which is located close to the first end faces 216 of the columns 214. The second pawl 25 located above the first pawl 24 has a top face which is located close to the second end face 285. There are three connection holes 284 defined in the block 283. The top part 28 has a fourth hole 286 defined centrally therethrough, the fourth hole 286 is located in alignment with the receiving room 218.

The four locking members 29 respectively extend through the connection holes 284, the first hole 241, the second holes 251, the third hole 261 and the circular holes 215, and are locked to the locking holes 217 to pivotably connect the first pawl 24, the second pawls 25 and the third pawl 26 to the locking members 29. The locking members 29 each are a cylindrical member and has threads at one end thereof. Two of the locking members 29 extend through the connection holes 284 of the top part 28 and the circular holes 215 of the bottom part 21 and are locked to the locking holes 217 corresponding thereto. One of the four locking members 29 extends through the connection hole 284 of the top part 28, the second hole 251, the first hole 251 and the first hole 241 and is locked to the locking hole 217 corresponding thereto. Another one of the locking members 29 extends through the connection hole 284 of the top part 28, the third hole 261, the second hole 251 and the circular hole 215 and is locked to the locking hole 217 corresponding thereto.

The control unit 30 is connected to the driving unit 20 and has an operation disk 31, a shaft 32, a first controller 33, two second controllers 34 and a third controller 35. The operation disk 31 is pivotably connected to the top part 28 and protrudes beyond the annular head 10 such that the user can rotates the operation disk 31. The shaft 32 extends from the center of the operation disk 31 and is pivotably extends through the fourth hole 286 and inserted into the receiving room 218 of the bottom part 21. The first controller 33 is a semi-circular member and protrudes radially from the shaft 32 and is located in alignment with the inside of the first pawl 24 so as to control the direction of rotation of the first pawl 24. The two second controllers 34 each are a semi-circular member and symmetrically extend from the outside of the shaft 32 and are located in alignment with two respective insides of the second pawls 25 so as to control the direction of rotation of the two second pawls 25. The third controller 35 protrudes radially from the shaft 32 and is located in alignment with the inside of the third pawl 25 so as to control the direction of rotation of the third pawl 25.

The rotary member 40 is pivotably located in the axial hole 16 and has third teeth 41 at the front end thereof. The front end of the rotary member 40 is for inserting into the inner periphery of the annular head 10 and for mechanically connecting with the driving unit 20. The third teeth 41 are engaged with the first and second teeth 231, 271 at the lateral openings 171 of the front end 170 of the communication hole 17. A rectangular recess 42 is defined in the rear end of the rotary member 40. An engaging groove 43 is defined in the outside of the rotary member 40 and located in alignment with the receiving hole 18. The driving unit 20 will be actuated to drive the workpiece when the rotary member 40 is rotated in the axial hole 16.

Figure 14:
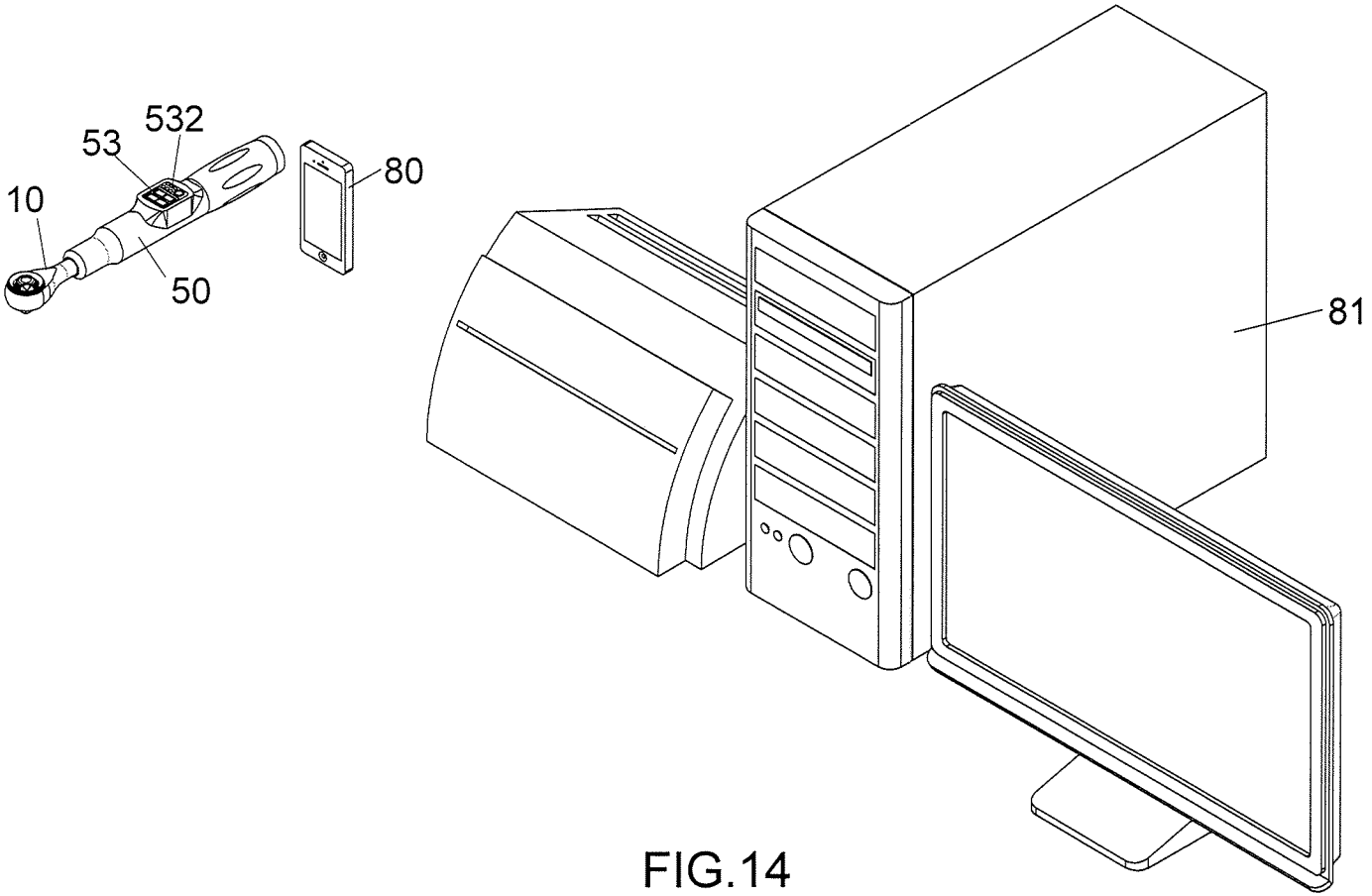
FIG. 14 is a perspective view to show the third embodiment of the ratchet wrench of the present invention.

The forcing unit 50 includes a tubular handle 51, a display unit 53, a battery seat 54 and at least one battery 55. The handle 51 has an axial chamber 511 which is communicated with the axial hole 16. A receiving inner portion 515 is defined in a front portion 512 of the axial chamber 511. The receiving inner portion 515 is mounted with the shaft 100 of the annular head 10. An outer periphery of the handle 51 is defined a lateral recess 514 therefrom. The lateral recess 514 is in communication with the axial chamber 511. A driving part 520 is received in the axial chamber 511. The driving part 520 is sleeved with the rectangular recess 42 of the rear end of the rotary member 40. When the driving part 520 rotates to rotate the rotary member 40, the driving unit 20 is actuated by the rotary member 40 so that the driving end 219 drives the workpiece. The display unit 53 is received in the lateral recess 514. The battery seat 54 is disposed in a rear portion of the axial chamber 511, and the battery seat 54 has a receiving chamber 541 for accommodating the at least one battery 55. The at least one battery 55 provides electric power for the display unit 53. The forcing unit 50 includes an electric motor 52. The at least one battery 56 provides electric power for the electric motor 52. The electric motor 52 is received and fixed in the chamber 511. The driving part 520 has a connecting port 521 and is fixedly mounted on an output end of the electric motor 52. The connecting port 521 is connected with the rear end of the rotary member 40. When the electric motor 52 starts to rotate the driving part 520, the driving part 520 rotates the rotary member 40, so that the rotary member 40 actuates the driving unit 20 to drive the workpiece. The display unit 53 includes a starting switch 530. The starting switch 530 is for controlling the electric motor 52 on and off. A wall of the axial chamber 511 is defined two penetrating holes 516 therethrough, an outer periphery of the electric motor 52 is defined two locking holes 522 therefrom, and two locking pins 57 respectively mount in the corresponding penetrating hole 516 and locking hole 522 so as to fix the electric motor 52 in the axial chamber 511. A cover 56 is mounted to an opening 513 of a rear end portion of the axial chamber 511 for limiting the battery seat 54 in the axial chamber 511 and limiting the at least one battery 55 in the battery seat 54. The driving part 520 of the forcing unit 50 is provided a rotating force by a pneumatic power source, an electric power source or a manual power source. The display unit 53 includes a wireless transmitting module 532, the wireless transmitting module 532 transmits the torque value to a mobile phone 80 or a computer 81 (referring to FIGS. 1 and 14). An outer portion of the shaft 100 is defined an embossing structure 101 thereon (referring to FIG. 1), the embossing structure 101 is tightly coupled with an inner wall of the axial chamber 511 so that the handle 51 and the shaft 100 are non-rotatably fixed.

The bead 60 is located in the receiving hole 18 and engaged with the engaging groove 43 so that the rotary member 40 is restricted by the bead 60 and does not drop from the axial hole 16. When the rotary member 40 is rotated by the forcing unit 50, the bead 60 rolls in the engaging groove 43 to reduce wearing. The end piece 61 is securely engaged with the receiving hole 18 and restricts the bead 60 from dropping out from the receiving hole 18. The end piece 61 has outer threads which are threadedly connected to the receiving hole 18. The end piece 61 limits the bead 60 in the receiving hole 18.

Figure 13:
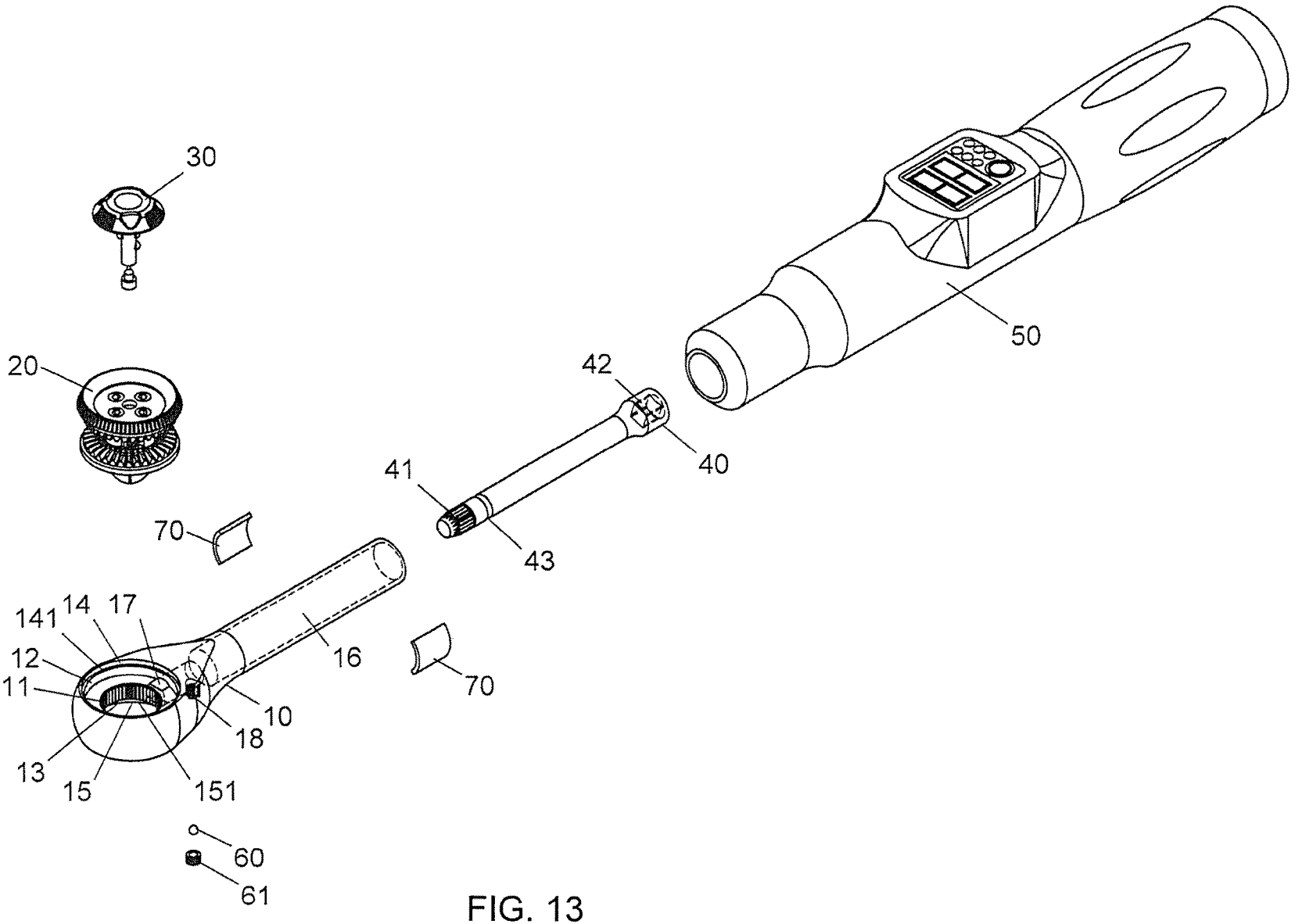
FIG. 13 is an exploded view to show the second embodiment of the ratchet wrench of the present invention.

The at least one torque sensor 70 is mounted on an outer periphery of the shaft 100, received in the axial chamber 511 and electrically connected with the display unit 53. When a user drives the handle 51 to actuate the driving unit 20 to drive the workpiece, the shaft 100 is bended by the handle 51 to produce a deformation. The at least one torque sensor 70 senses the deformation of the shaft 100 to generate a torque sensing signal and transmits the torque sensing signal to the display unit 53, and the display unit 53 converts the torque sensing signal to a torque value and displays the torque value. In one embodiment, the at least one torque sensor 70 is two torque sensors 70 (referring to FIG. 13), the two torque sensors 70 are symmetrical to a central axis of the shaft 100. In one embodiment, the torque sensor 70 is a strain gauge.

Figure 15:
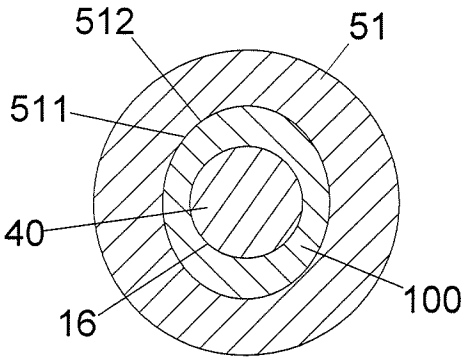
FIG. 15 is a cross sectional view to show the outline of outer portion of the shaft in non-circular shape of the present invention.

Referring to FIG. 15, an outline of a cross section of an outer portion of the shaft 100 is non-circular, the outer portion is tightly coupled with an inner wall of the axial chamber 511 so that the handle 51 and the shaft 100 are non-rotatably connected.

Referring to FIGS. 1 and 8-12, the driving unit 20 is connected to the annular head 10. The top part 28 protrudes from the annular head 10. The control unit 30 is located in the driving unit 20. The operation disk 31 is pivotably connected to the top part 28 and protrudes beyond the annular head 10 so that the user may rotate it to change the operation direction of the driving unit 20. The rotary member 40 is rotatably received in the axial hole 16 and the communication hole 17. The forcing unit 50 is connected to the rotary member 40. The bead 60 and the end piece 61 are located in the receiving hole 18. The bead 61 restricts the rotary member 40 from dropping out from the shaft 100.

Figure 8:
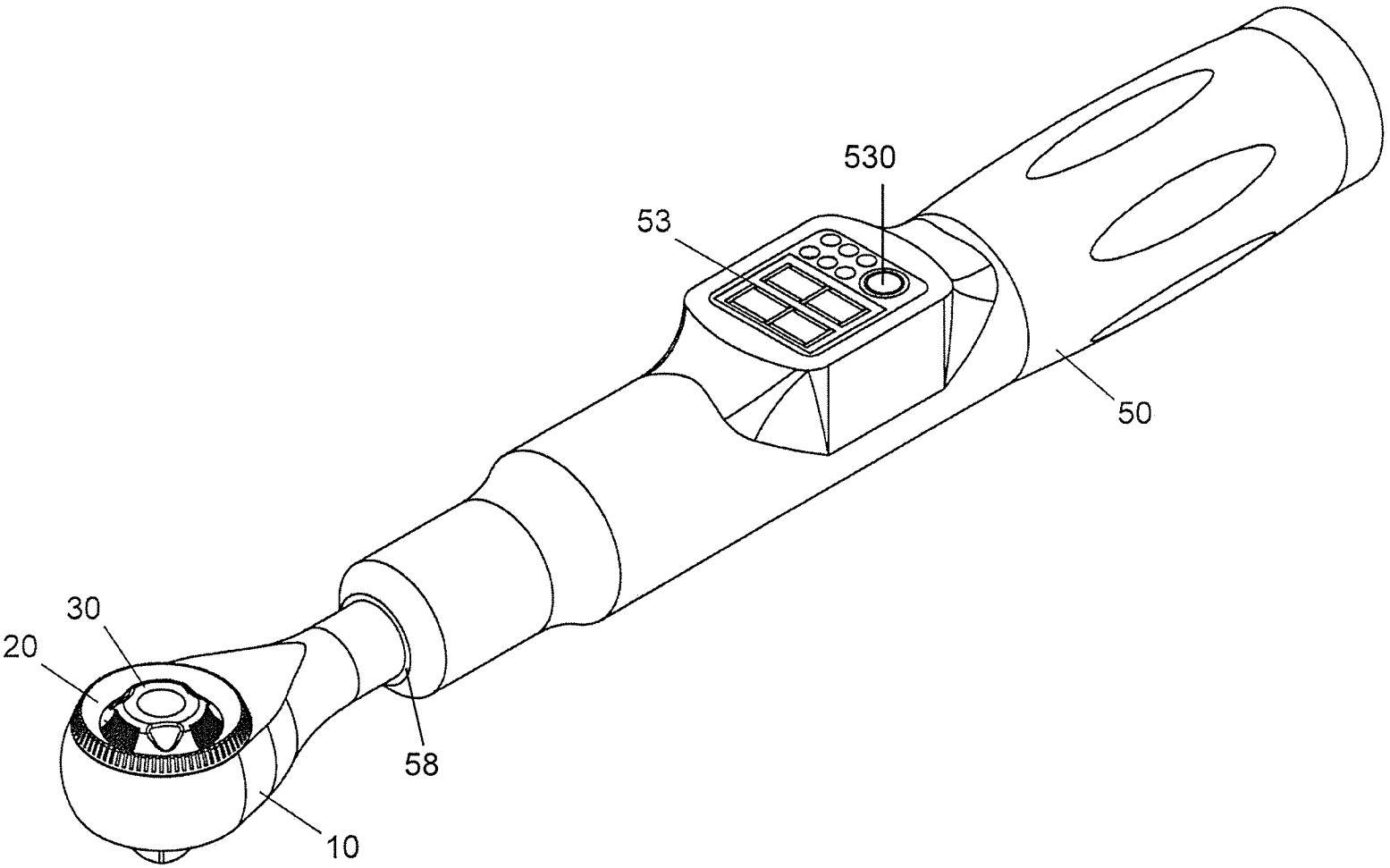
FIG. 8 is a perspective view to show the ratchet wrench of the present invention.
Figure 9:
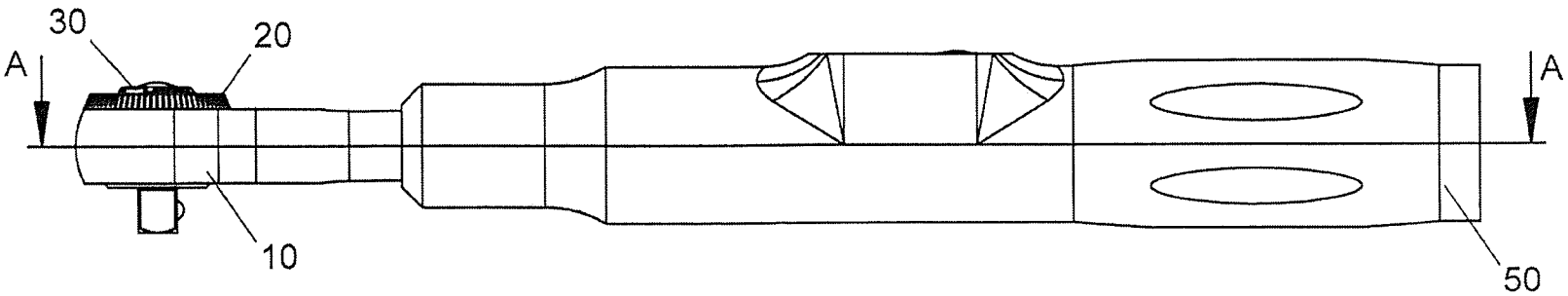
FIG. 9 is a side view of the ratchet wrench of the present invention.
Figure 10:
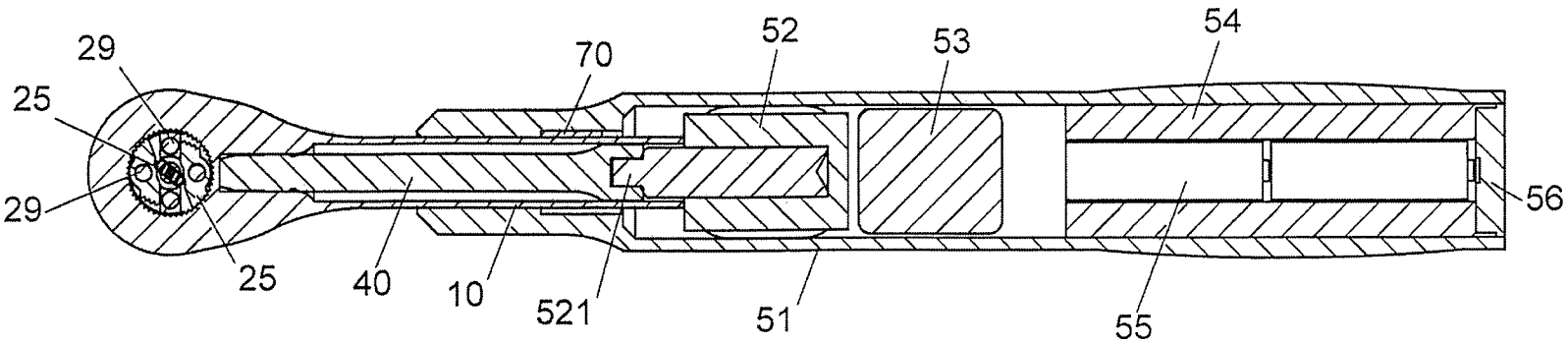
FIG. 10 is a cross sectional view, taken along line A-A in FIG. 9.
Figure 11:
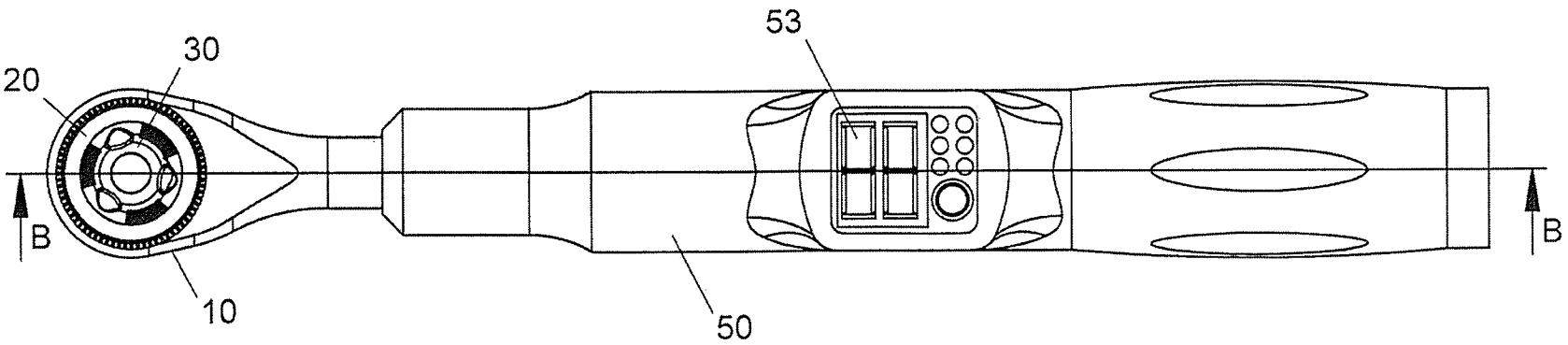
FIG. 11 is a top view to show the ratchet wrench of the present invention.
Figure 12:
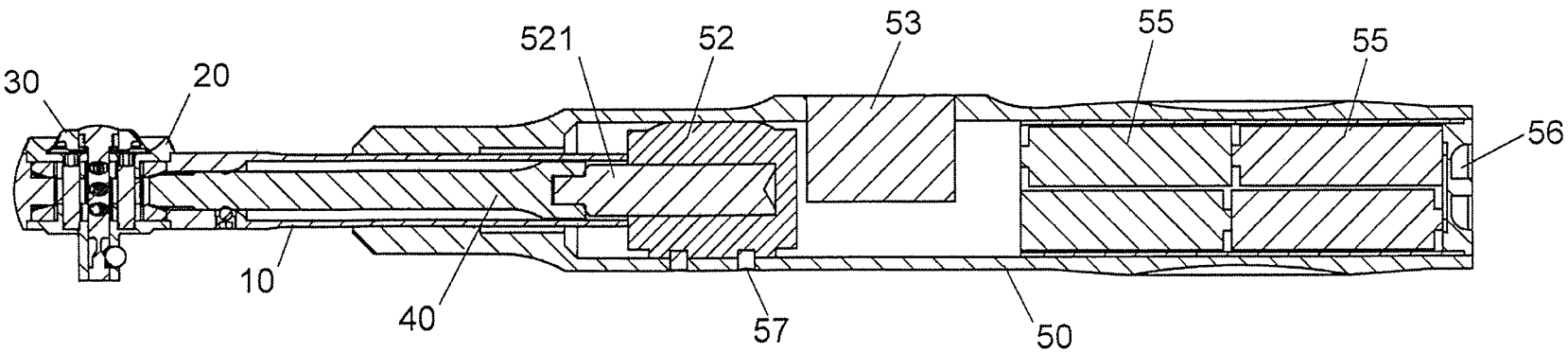
FIG. 12 is a cross sectional view, taken along line B-B in FIG. 11.

Referring to FIG. 8, a gap between the shaft and the receiving inner portion 515 is sealed by a sealing ring 58.

Referring to FIGS. 1-12, the locking members 29 extend through the connection holes 284, the first hole 241, the second holes 251, the third hole 261, the circular holes 215 and are locked to the locking holes 217 to pivotably connect the first pawl 24, the second pawls 25 and the third pawl 26 to the locking members 29. The second toothed portions of the second pawls 25 are engaged with the ratchet teeth 11. The shaft 32 is inserted into the receiving room 218. The second controllers 34 contact the insides of the second pawls 25 to change the rotational direction of the second pawls 25.

Referring to FIGS. 1-12, the bottom part 21 is engaged with the first groove 15 and protrudes beyond the annular head 10. The first toothed ring 23 is located in the second space 13. The first pawl 24 is located on the first disk 212 and located in the first toothed ring 23. The first toothed portions 24 are engaged with the first inner teeth 232. The two second pawls 25 are located above the first pawl 24 and the base 213. The second toothed portions of the second pawls 25 are engaged with the ratchet teeth 11. The third pawl 26 is located on the second disk 282 and located between the second pawls 25 and the second disk 282. The second toothed ring 27 is located in the first space 12. The third pawl 26 is located in the second toothed ring 27. The third toothed portions of the third pawl 26 are engaged with the second inner teeth 272. The top part 28 is engaged with the first groove 14 and protrudes beyond the annular head 10. The four locking members 29 assemble the parts of the driving unit 20 together. The control unit 30 is pivotably connected to the driving unit 20, and the operation disk 31 is exposed beyond the annular head 10 for being operated by the user. The first, second and third controllers 33, 34, 35 respectively contact the inside of the first pawl 24, the second pawls 25 and the third pawl 26. The operation disk 31 is rotated to change the rotational direction of the first, second and third pawls 24, 25, 26. The rotary member 40 is rotatably received in the axial hole 16 and its third teeth 41 are engaged with the first and second teeth 231, 271 at the communication hole 17. When the rotary member 40 is rotated, the third teeth 41 drives the first and second toothed rings 23, 27 simultaneously. The protrusion 51 is engaged with the recess 42.

Referring to FIG. 1, the bead 60 and the end piece 61 are located in the receiving hole 18. The bead 60 is engaged with the engaging groove 43 so that the rotary member 40 is restricted by the bead 60 and does not drop from the axial hole 16. The bead 60 rolls in the engaging groove 43 to reduce wearing.

Referring to FIGS. 1-12, the periphery 211 of the bottom part 21 is engaged with the second groove 15, and the periphery 281 of the top part 28 is engaged with the first groove 14 so that the connection between the annular head 10 and the driving unit 20 is stable. The first disk 212 contacts the second shoulder 151, and the second disk 282 contacts the first shoulder 141, so that the driving unit 20 does not drop from the annular head 10. The bottom part 21, the first toothed ring 23, the first pawl 24, the second pawls 25, the third pawl 26, the second toothed ring 27 and the top part 28 are stably connected by the locking members 29. The wearing between the rotary member 40 and the engaging groove 43 is reduced by the bead 60 locate between the engaging groove 43 and the end piece 61.

While we have shown and described the embodiment in accordance with the present invention, it should be clear to those skilled in the art that further embodiments may be made without departing from the scope of the present invention.

What is claimed is:

1. A ratchet wrench comprising:

an annular head having a shaft extending therefrom, multiple ratchet teeth defined in an middle portion of an inner periphery of the annular head, an axial hole defined axially in the shaft therethrough, one end of the axial hole communicating with the inner periphery of the annular head; a first space and a second space being respectively defined in a top and a bottom of the inner periphery of the annular head; a first groove being defined in an inner periphery of the first space, and a second groove being defined in an inner periphery of the second space; a first shoulder being formed between the first groove and the first space, and a second shoulder being formed between the second groove and the second space; a communication hole being defined in an inner end of the axial hole and having a front end respectively communicating with the first and second spaces by lateral openings of the front end;

a driving unit located in the annular head; the driving unit having a top part, a bottom part, a first toothed ring, a first pawl, two second pawls, a third pawl, a second toothed ring and multiple locking members; the bottom part having a driving end for connecting with a workpiece; the multiple locking members connecting the top part and the bottom part, and pivotably connecting the first pawl, the two second pawls and the third pawl; the top part having a second disk and multiple connection holes; a block extending from the second disk; the second toothed ring having second teeth, second inner teeth for engaging with a third toothed portion of the third pawl, and being rotatably mounted to the block; the bottom part having a first disk and multiple locking holes which are located in alignment with the multiple connection holes correspondingly, a base extending from the first disk, and two columns each having a first end face; a receiving room being formed between the two columns; two of the multiple locking holes respectively extend through the first end faces of the columns; the first toothed ring having first teeth and first inner teeth, and being rotatably mounted to the base; a first toothed portion formed on each of two ends of the first pawl for engaging with the first inner teeth; a second toothed portion formed on each of two ends of the two second pawl for engaging with the multiple ratchet teeth of the annular head; peripheries of the bottom part and the top part being engaged with the second groove and the first groove respectively; peripheries of the first disk and the second disk contacting the second shoulder and the first shoulder respectively; one of the two second pawls being mounted to the base and the other second pawl being located above the first pawl; each of the two second pawls having a second hole; the second hole of one of the second pawls that is located above the base being located in alignment with one of the multiple locking hole; the second hole of the other one of the second pawls that is located above the first pawl being located in alignment with another one of the multiple locking hole; the multiple locking members correspondingly extending through the multiple connection holes, the first hole, the two second holes and the third hole, and being correspondingly locked to the multiple locking holes to pivotably connect the first pawl, the two second pawls and the third pawl to the locking members;

a rotary member pivotably located in the axial hole and having a front side for inserting into the inner periphery of the annular head and for mechanically connecting with the driving unit; the driving unit configured to be actuated to drive the workpiece when the rotary member being rotated in the axial hole; the rotary member having third teeth at the front side thereof; the third teeth being engaged with the first and second teeth at the lateral openings of the front end of the communication hole; a rectangular recess being defined in the rear end of the rotary member;

a forcing unit including a tubular handle, a display unit, an electric motor, a battery seat and at least one battery for providing electric power for the electric motor, the handle having an axial chamber which is communicated with the axial hole; a receiving inner portion being defined in a front portion of the axial chamber, the receiving inner portion being mounted with the shaft of the annular head; an outer periphery of the handle being defined a lateral recess therefrom, the lateral recess being in communication with the axial chamber; the electric motor being received and fixed in the axial chamber; a driving part having a connecting port and being received in the axial chamber; one end of the driving part being fixedly mounted on an output end of the electric motor, and the other end of the driving part being sleeved with a rear end of the rotary member by the connecting port; wherein when the driving part rotates to rotate the rotary member, the driving unit is actuated by the rotary member so that the driving end drives the workpiece; the display unit being received in the lateral recess; the battery seat being disposed in a rear portion of the axial chamber, and the battery seat having a receiving chamber for accommodating the at least one battery; the at least one battery providing electric power for the display unit; a wall of the axial chamber being defined two penetrating holes therethrough, an outer periphery of the electric motor being defined two locking holes therefrom, and two locking pins respectively mounting in the corresponding penetrating hole and locking hole so as to fix the electric motor in the axial chamber;

at least one torque sensor being mounted on an outer periphery of the shaft of the annular head, being received in the axial chamber and being electrically connected with the display unit; wherein, when a user drives the handle to actuate the driving unit to drive the workpiece, the shaft of the annular head is bended by the handle to produce a deformation, the at least one torque sensor senses the deformation of the shaft of the annular head to generate a torque sensing signal; the display unit being configured to receive the torque sensing signal, and to convert the torque sensing signal to a torque value and display the torque value.

2. The ratchet wrench as claimed in claim 1, the display unit includes a starting switch, the starting switch is for controlling the electric motor on and off.

3. The ratchet wrench as claimed in claim 1, wherein a cover is mounted to an opening of a rear end portion of the axial chamber for limiting the battery seat in the axial chamber and limiting the at least one battery in the battery seat.

4. The ratchet wrench as claimed in claim 1, wherein the at least one torque sensor is two torque sensors, the two torque sensors are symmetrical to a central axis of the shaft.

5. The ratchet wrench as claimed in claim 1, wherein an outline of a cross section of an outer portion of the shaft is non-circular, the outer portion is tightly coupled with an inner wall of the axial chamber so that the handle and the shaft are non-rotatably connected.

6. The ratchet wrench as claimed in claim 1, wherein the display unit includes a wireless transmitting module, the wireless transmitting module configured to transmits the torque value to a mobile phone or a computer.

7. The ratchet wrench as claimed in claim 1, wherein an outer portion of the shaft is defined an embossing structure thereon, the embossing structure is tightly coupled with an inner wall of the axial chamber so that the handle and the shaft are non-rotatably fixed.

8. The ratchet wrench as claimed in claim 1, wherein a gap between the shaft and the receiving inner portion is sealed by a sealing ring.

9. The ratchet wrench as claimed in claim 1, wherein a receiving hole being defined in a side of the shaft and communicating with the axial hole; a bead and an end piece are respectively located in the receiving hole; the end piece has outer threads which are threadedly connected to the receiving hole; the end piece limits the bead in the receiving hole; the bead is engaged with the engaging groove to restrict the rotary member from moving along an axial line of the axial hole.

10. The ratchet wrench as claimed in claim 1; wherein the top part having a fourth hole defined centrally therethrough, the fourth hole being located in alignment with the receiving room; a control unit is connected to the driving unit and has an operation disk, a shaft, a first controller, two second controllers and a third controller; the shaft of the control unit extends from a center of the operation disk and pivotably extending through the fourth hole and inserting into the receiving room; the first controller is a semi-circular member and protrudes radially from the shaft of the control unit and is located in alignment with the inside of the first paw so as to control the direction of rotation of the first pawl; each of the two second controllers is a semi-circular member and symmetrically extends from the outside of the shaft of the control unit and is located in alignment with two respective insides of the second pawls so as to control the direction of rotation of each of the two second pawls; the third controller is a semi-circular member and protrudes radially from the shaft of the control unit and is located in alignment with the inside of the third pawl so as to control the direction of rotation of the third pawl.

* * * * *